US008424605B1

(12) United States Patent
Schultz et al.

(10) Patent No.: US 8,424,605 B1
(45) Date of Patent: Apr. 23, 2013

(54) METHODS AND DEVICES FOR CASING AND CEMENTING WELL BORES

(75) Inventors: Roger L. Schultz, Ninnekah, OK (US); Chad A. Johnson, Tyler, TX (US); Andrew M. Ferguson, Oklahoma City, OK (US)

(73) Assignee: Thru Tubing Solutions, Inc., Oklahoma City, OK (US)

( * ) Notice: Subject to any disclaimer, the term of this patent is extended or adjusted under 35 U.S.C. 154(b) by 0 days.

(21) Appl. No.: 13/455,554

(22) Filed: Apr. 25, 2012

Related U.S. Application Data

(63) Continuation-in-part of application No. 13/427,141, filed on Mar. 22, 2012, which is a continuation-in-part of application No. 13/110,696, filed on May 18, 2011.

(51) Int. Cl.
*E21B 33/13* (2006.01)
*E21B 33/14* (2006.01)

(52) U.S. Cl.
USPC ..... 166/286; 166/285; 166/177.4; 166/177.6

(58) Field of Classification Search ..... 166/285, 166/286, 380, 381, 177.4, 177.6
See application file for complete search history.

(56) References Cited

U.S. PATENT DOCUMENTS

| | | | |
|---|---|---|---|
| 3,016,066 | A | 1/1962 | Warren |
| 3,238,960 | A | 3/1966 | Hatch |
| 3,534,756 | A | 10/1970 | Swartz |
| 3,552,413 | A | 1/1971 | Warren et al. |
| 3,584,635 | A | 6/1971 | Warren |
| 3,605,778 | A | 9/1971 | Metzger |
| 3,719,195 | A | 3/1973 | Matsuda |
| 3,926,373 | A | 12/1975 | Viets |
| 4,005,854 | A | 2/1977 | Patton |
| 4,052,002 | A | 10/1977 | Stouffer et al. |
| 4,134,100 | A | 1/1979 | Funke |
| 4,231,519 | A | 11/1980 | Bauer |
| 4,276,943 | A | 7/1981 | Holmes |
| 4,286,627 | A | 9/1981 | Graf |

(Continued)

FOREIGN PATENT DOCUMENTS

| | | | |
|---|---|---|---|
| EP | 0304988 | A1 | 3/1989 |
| GB | 2272924 | A | 6/1994 |
| WO | 2005093264 | A1 | 10/2005 |

OTHER PUBLICATIONS

Form PCT/ISA/206 (Annex) issued in International Application No. PCT/US2012/037681, issued Feb. 21, 2013, which application corresponds to the instant application.

*Primary Examiner* — Brad Harcourt
(74) *Attorney, Agent, or Firm* — Mary M. Lee

(57) ABSTRACT

A casing string is augmented with one or more variable flow resistance devices or "vibrating tools" to facilitate advancement of the casing and distribution of the cement in the annulus once the casing is properly positioned. The method includes vibrating the casing string while advancing the casing down the wellbore or while the cement is pumped into the annulus, or both. After the cementing operation is completed, the devices may be drilled out to open the casing string for further operations. The casing string assembly may include a vibrating tool at the end in place of a conventional float shoe or float collar. Multiple vibrating tools can be employed in the casing string, and they may be combined with conventional float shoes and collars. Additionally, vibrating tools in the form of plugs can be pumped down and landed inside the casing string.

23 Claims, 6 Drawing Sheets

U.S. PATENT DOCUMENTS 4,291,395 A 9/1981 Holmes
4,323,991 A 4/1982 Holmes et al.
4,418,721 A 12/1983 Holmes
4,550,614 A 11/1985 Herzl
4,774,975 A 10/1988 Ayers et al.
4,817,863 A 4/1989 Bragg et al.
4,905,909 A 3/1990 Woods
4,943,007 A 7/1990 Bowe et al.
4,976,155 A 12/1990 Challandes
5,063,786 A 11/1991 Sanderson et al.
5,152,342 A * 10/1992 Rankin et al. ..... 166/286
5,190,099 A 3/1993 Mon
5,229,081 A 7/1993 Suda
5,455,804 A 10/1995 Holmes et al.
5,827,976 A 10/1998 Stouffer et al.
5,906,317 A 5/1999 Srinath
6,240,945 B1 6/2001 Srinath et al.
6,439,866 B1 8/2002 Farkas et al.
6,553,844 B2 4/2003 Drzewiecki
6,564,868 B1 5/2003 Ferguson et al.
6,581,856 B1 6/2003 Srinath
6,860,157 B1 3/2005 Yang et al.
6,976,507 B1 12/2005 Webb et al.
7,128,082 B1 10/2006 Cerretelli et al.
7,204,156 B2 4/2007 Samms et al.
7,267,290 B2 9/2007 Gopalan et al.
7,360,446 B2 4/2008 Dai et al.
7,404,416 B2 7/2008 Schultz et al.
7,464,609 B2 12/2008 Fallet
7,472,848 B2 1/2009 Gopalan et al.
7,478,764 B2 1/2009 Gopalan
7,481,119 B2 1/2009 Yang et al.
7,651,036 B2 1/2010 Gopalan
7,775,456 B2 8/2010 Gopalan et al.
7,806,184 B2 10/2010 Schultz et al.
7,827,870 B2 11/2010 Cottam et al.
7,909,094 B2 3/2011 Schultz et al.
8,066,059 B2 11/2011 Ferguson et al.
8,070,424 B2 12/2011 Priestman et al.
2005/0214147 A1 9/2005 Schultz et al.
2006/0201675 A1 9/2006 Ferguson et al.
2009/0008088 A1 1/2009 Schultz et al.
2009/0159282 A1 6/2009 Webb et al.
2009/0178801 A1 7/2009 Nguyen et al.
2009/0277639 A1 11/2009 Schultz et al.
2010/0276204 A1 11/2010 Connell et al.
2011/0042091 A1 2/2011 Dykstra et al.
2011/0042092 A1 2/2011 Fripp et al.
2011/0114316 A2 5/2011 Ferguson et al.
2011/0259602 A1 10/2011 Britton
2011/0290485 A1 * 12/2011 Cooke, Jr. ..... 166/286
2011/0315403 A1 12/2011 Nard et al.
2012/0024519 A1 2/2012 Ferguson et al.
2012/0024538 A1 2/2012 Britton
2012/0031615 A1 2/2012 Connell et al.

* cited by examiner

METHODS AND DEVICES FOR CASING AND CEMENTING WELL BORES

CROSS-REFERENCE TO RELATED APPLICATIONS

This application is a continuation-in-part of co-pending application Ser. No. 13/427,141 entitled "Vortex Controlled Variable Flow Resistance Device and Related Tools and Methods," filed Mar. 22, 2012, which is a continuation-in-part of co-pending patent application Ser. No. 13/110,696 entitled "Vortex Controlled Variable Flow Resistance Device and Related Tools and Methods," filed May 18, 2011. The contents of these prior applications are incorporated herein by reference.

FIELD OF THE INVENTION

The present invention relates generally to casing and cementing well bores.

DETAILED DESCRIPTION OF THE PREFERRED EMBODIMENT(S)

Once a section of wellbore is drilled, it must be cased. This involves positioning the casing in the target location and then filling annular space between the casing and the wall of the wellbore with cement. In many cases, the wellbore is cased in sections, each subsequent section having a slightly smaller diameter casing than the previous section, make a so-called "tapered" casing string. In deep wells, and especially in horizontal well operations, the frictional forces between the casing string and the borehole wall make advancing the casing string very difficult. These frictional forces are exacerbated by deviations in the wellbore, hydraulic loading against the wellbore, and, especially in horizontal wells, gravity acting on the drill string.

The present invention is directed to methods and devices for finishing a wellbore, that is, for positioning the casing in the wellbore or for cementing the emplaced casing or both. These methods and devices employ a vibrating tool in the casing string to facilitate advancement of the string. As used herein, "vibrating tool" refers to a tool comprising a variable flow resistance device, that is, a force generating tool that repetitively interrupts fluid flow to generate cyclic hydraulic loading on the casing string, thereby causing repeated extension and contraction of the casing string. This vibratory motion breaks the static friction reducing the drag force on the casing string. The pulsating motion of the casing string caused by the vibrating tool helps advance the casing string along the borehole. Additionally, during the cementing operation, the pulsing and vibration of the casing string enhances the distribution of the cement as it is pumped into the annulus around the casing. Advantageously, where a drillable vibrating tool is used, the tools can be drilled out once the cementing operation is completed.

Figure 1:
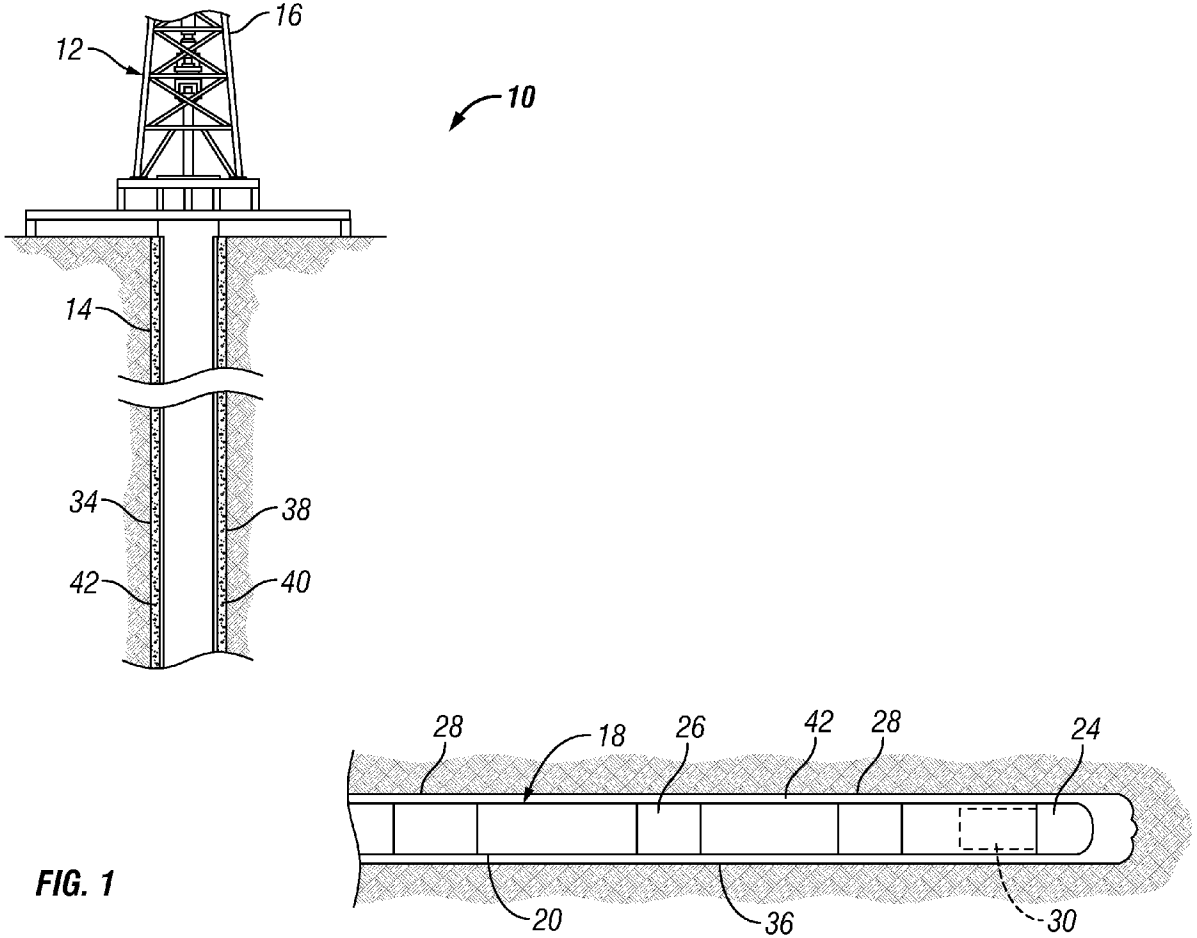
FIG. 1 is a diagrammatic illustration of a casing string deployment system comprising a plurality of variable flow resistance devices in accordance with the present invention.

Turning now to the drawings in general and to FIG. 1 in particular, there is shown therein an oil well designated generally by the reference number 10. A typical derrick-type casing deployment system 12 is shown at the wellhead for casing the well as the wellbore 14 is extended. However, as used herein, "casing deployment system" means any system or structure for supporting and advancing the casing string for lining the wellbore 14. Typically, the exemplary casing deployment system 12 includes a derrick 16 and the casing string assembly 18.

The casing string assembly 18 includes tools, such as float shoes and float collars, that are connected in the casing string 20. The number, type, and location of such tools in the casing string assembly 18 may vary. In the casing string assembly 18, the casing string 20 is equipped with a float shoe 24, a float collar 26, and two vibrating collars both designated at 28. Additionally, the casing string assembly 18 includes a vibrating plug 30. As will be described in detail hereafter, the vibrating tool of the present invention may take the form of a collar, plug, or shoe, but usually will be combined with one or more conventional float shoes or collars. It will be understood that although the casing string 18 includes all these types of device, in practice not all these tools would be used together as shown. For example, the operator may run the plug after drilling out one or more of the collars.

The wellbore 14 comprises a vertical section 34 and a generally horizontal section 36. The vertical section is lined with casing 38. The casing 38 is secured by cement 40 in the annulus 42 between the walls of the wellbore 14 and the casing. The casing string assembly 18 is shown positioned in the still uncased horizontal section 36.

Figure 2:
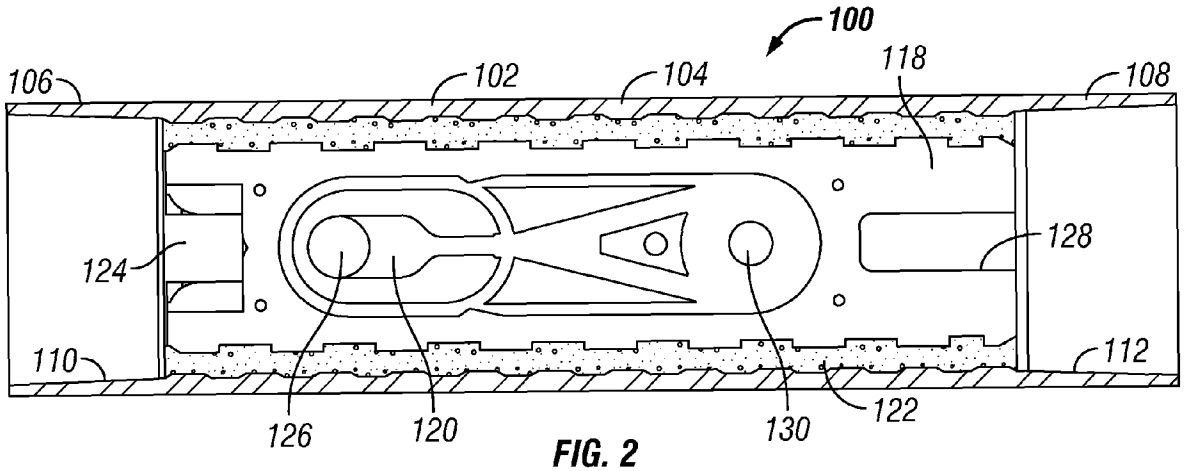
FIG. 2 is a longitudinal sectional view of a preferred casing collar comprising a variable flow resistance device in accordance with a preferred embodiment of the present invention.

FIG. 2 shows a casing collar embodiment of the preferred vibrating tool of the present invention and is designated generally at 100. The vibrating tool 100 comprises a housing 102 with a body section 104 having uphole and downhole ends 106 and 108, each adapted for connection to the casing string 20 or to another tool in the casing string assembly 18. In most instances, the ends 106 and 108 will be threaded at 110 and 112. The housing 102 preferably is made from tubular steel.

An insert 118 is secured inside the body section 104 of the housing 102. The insert 118 defines a flow path 120 for generating pulsations, as described in more detail hereafter. In most instances, it will be desirable to form the insert 118, as well as the housing 102, of a drillable material. While the housing 102 may be made of tubular steel, it is advantageous to make the insert 118 out of rubber, brass, aluminum, composite, or plastic. In one preferred embodiment, the insert 118 is molded of rubber. In particular, the insert 118 preferably is molded in two halves forming opposing inner faces, only one of which is shown herein. The flow path 120 may be formed as a patterned recess in each of the faces, which together form a complete flow path. The insert 118 may be permanently secured inside the body section 104 using a high strength cement 122, such as Portland cement, some other drillable adhesive.

The insert 118 includes an insert inlet 124 continuous with the uphole end 106 of the tool 100. The insert inlet 124 directs fluid to enter flow path inlet 126. The insert 118 includes an insert outlet 128 that receives fluid leaving the flow path 120 through the flow path outlet 130. In this way, fluid flowing through the casing string assembly is forced through the flow path 118.

Figure 3:
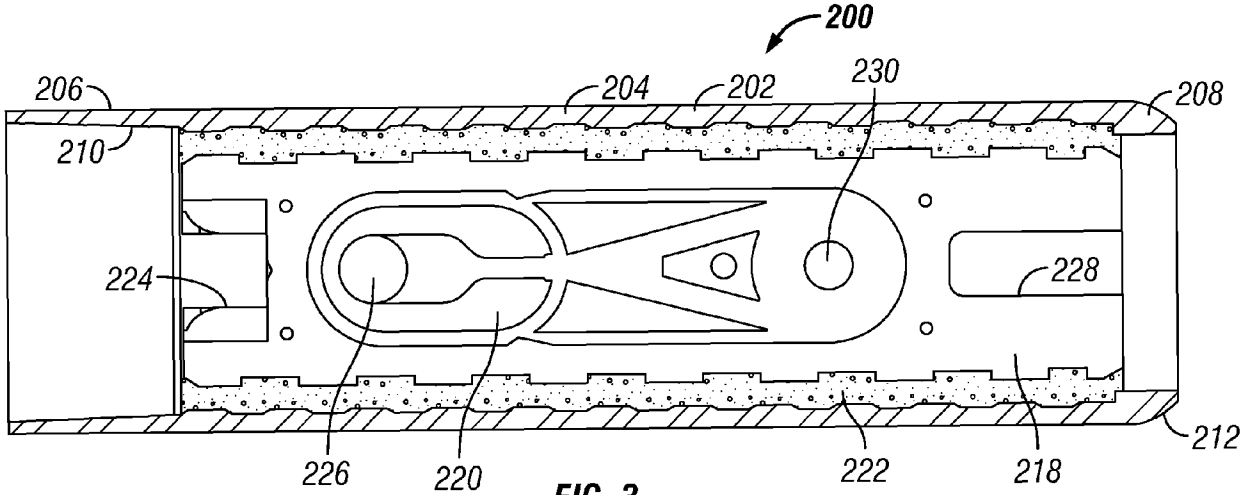
FIG. 3 is a longitudinal sectional view of a preferred casing shoe comprising a variable flow resistance device in accordance with a preferred embodiment of the present invention.

FIG. 3 shows a casing shoe embodiment of the preferred vibrating tool of the present invention and is designated generally at 200. The vibrating tool 200 comprises a housing 202 with a body section 204 having uphole and downhole ends 206 and 208. The uphole end 206 is adapted for connection to the casing string 20 or to another tool in the casing string assembly 18. In most instances, the uphole end 206 will be threaded at 210. The downhole end 208 is open and the edge 212 surrounding the open end beveled or radiused or otherwise blunted in a known manner to facilitate advancement of the leading end of the casing string assembly 18.

The tool 200 includes an insert 218 secured inside the body section 204 of the housing 202 using cement 222. The insert 218 defines a flow path 220 similar to the flow path 120 of the tool 100 in FIG. 2, and includes an insert inlet 224 and insert outlet 228 continuous with a flow path inlet 226 and flow path outlet 230, as in the previously described collar embodiment.

Figure 4:
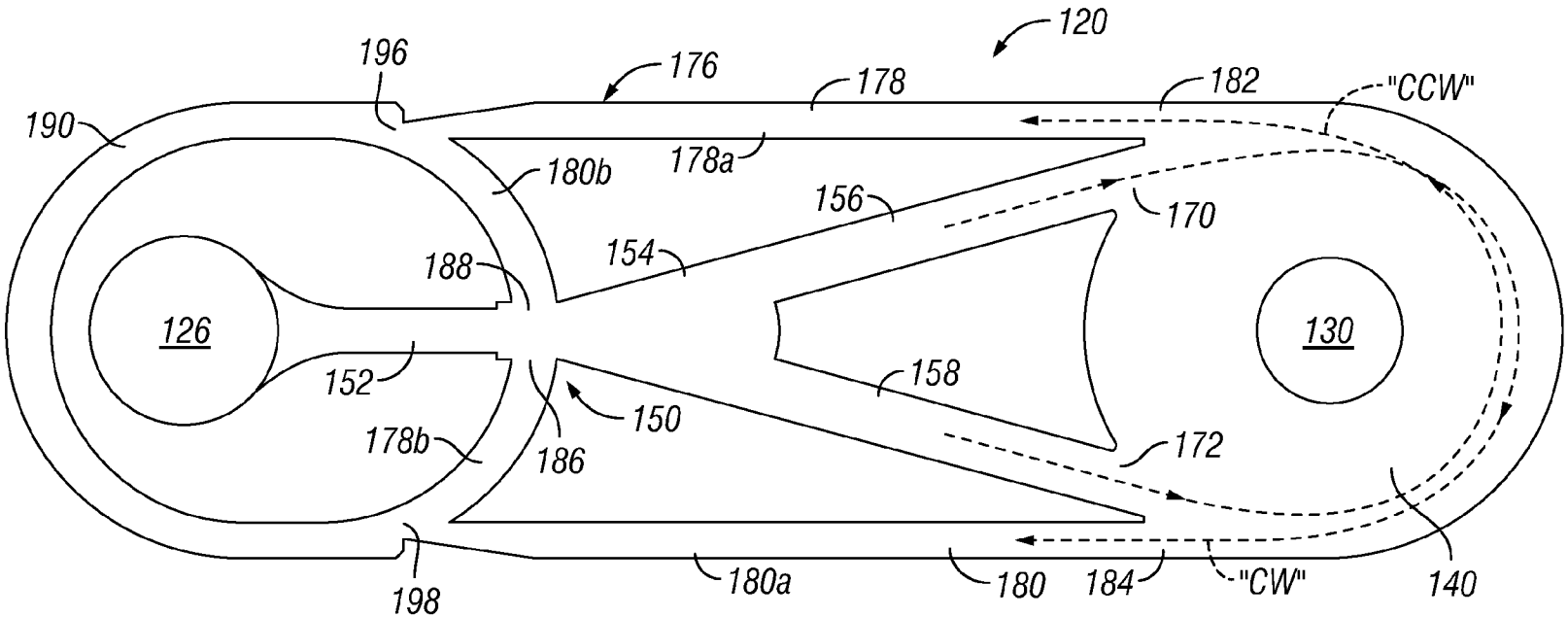
FIG. 4 is an illustration of the flow path of a preferred variable flow resistance device for use in the methods and devices of the present invention.

FIG. 4 shows the preferred flow path for use in the vibrating tools of the present invention. Since the flow paths 120 and 220 are similar, on the flow path 120 will be described in detail. Fluid enters the flow path 120 through the flow path inlet 126 and exits through the flow path outlet 130, as indicated previously. Fluid is directed from the inlet 126 to a vortex chamber 140 that is continuous with the outlet 130. In a known manner, fluid directed into the vortex chamber 140 tangentially will gradually form a vortex, either clockwise or counter-clockwise. As the vortex decays, the fluid exits the outlet 130.

A switch of some sort is used to reverse the direction of the vortex flow, and the vortex builds and decays again. As this process of building and decaying vortices repeats, and assuming a constant flow rate, the resistance to flow through flow path varies and a fluctuating backpressure is created above the device.

In the preferred embodiment, the switch, designated generally at 150, takes the form of a Y-shaped bi-stable fluidic switch. To that end, the flow path 120 includes a nozzle 152 that directs fluid from the inlet 126 into a jet chamber 154. The jet chamber 154 expands and then divides into two diverging input channels, the first input channel 156 and the second input channel 158, which are the legs of the Y.

According to normal fluid dynamics, and specifically the "Coanda effect," the fluid stream exiting the nozzle 152 will tend to adhere to or follow one or the other of the outer walls of the chamber so the majority of the fluid passes into one or other of the input channels 156 and 158. The flow will continue in this path until acted upon in some manner to shift to the other side of the jet chamber 154.

The ends of the input channels 156 and 158 connect to first and second inlet openings 170 and 172 in the periphery of the vortex chamber 140. The first and second inlet openings 170 and 172 are positioned to direct fluid in opposite, tangential paths into the vortex chamber. In this way, fluid entering the first inlet opening 170 produces a clockwise vortex indicated by the dashed line at "CW" in FIG. 4. Similarly, once shifted, fluid entering the second inlet opening 172 produces a counter-clockwise vortex indicated by the dotted line at "CCW."

As seen in FIG. 4, each of the first and second input channels 170 and 172 defines a flow path straight from the jet chamber 154 to the continuous openings 170 and 172 in the vortex chamber 140. This straight path enhances the efficiency of flow into the vortex chamber 140, as no momentum change in the fluid in the channels 170 or 172 is required to achieve tangent flow into the vortex chamber 140. Additionally, this direct flow path reduces erosive effects of the device surface.

In accordance with the present invention, some fluid flow from the vortex chamber 140 is used to shift the fluid from the nozzle 152 from one side of the jet chamber 154 to the other. For this purpose, the flow path 120 preferably includes a feedback control circuit, designated herein generally by the reference numeral 176. In its preferred form, the feedback control circuit 176 includes first and second feedback channels 178 and 180 that conduct fluid to control ports in the jet chamber 154, as described in more detail below. The first feedback channel 178 extends from a first feedback outlet 182 at the periphery of the vortex chamber 140. The second feedback channel 180 extends from a second feedback outlet 184 also at the periphery of the vortex chamber 140.

The first and second feedback outlets 182 and 184 are positioned to direct fluid in opposite, tangential paths out of the vortex chamber 140. Thus, when fluid is moving in a clockwise vortex CW, some of the fluid will tend to exit through the second feedback outlet 184 into the second feedback channel 180. Likewise, when fluid is moving in a counter-clockwise vortex CCW, some of the fluid will tend to exit through the first feedback outlet 182 into the first feedback channel 178.

With continuing reference to FIG. 4, the first feedback channel 178 connects the first feedback outlet 182 to a first control port 186 in the jet chamber 154, and the second feedback channel 180 connects the second feedback outlet 184 to a second control port 188. Although each feedback channel could be isolated or separate from the other, in this preferred embodiment of the flow path, the feedback channels 178 and 180 share a common curved section 190 through which fluid flows bidirectionally.

The first feedback channel 178 has a separate straight section **178*a* that connects the first feedback outlet 182 to the curved section 190 and a short connecting section 178*b* that connects the common curved section 190 to the control port 186, forming a generally J-shaped path. Similarly, the second feedback channel 180 has a separate straight section 118*a* that connects the second feedback outlet 184 to the common curved section 190 and a short connection section that connects the curved section to the second control port 188**.

The curved section 190 of the feedback circuit 176 together with the connecting sections **178*b* and 180*b* form an oval return loop extending between the first and second control ports 186 and 188. Alternately, two separate curved sections could be used, but the common bidirectional segment 190 promotes compactness of the overall design. It will also be noted that the diameter of the return loop approximates that of the vortex chamber 140. This allows the feedback channels 178 and 180** to be straight, which facilitates flow therethrough. However, these dimensions may be varied.

As seen in FIG. 4, in this configuration of the feedback control circuit 176, the ends of the straight sections **178*a* and 180*a* of the first and second feedback channels 178 and 180 join the return loop at the junctions of the common curved section 190 and each of the connecting section 178*b* and 180*b*. It may prove advantageous to include a jet 196 and 198 at each of these locations as this will accelerate fluid flow as it enters the curved section 190**.

It will be understood that the size, shape and location of the various openings and channels may vary. However, the configuration depicted in FIG. 4 is particularly advantageous. The first and second inlet openings 170 and 172 may be within about 60-90 degrees of each other. Additionally, the first inlet opening 170 is adjacent the first feedback outlet 182, and the second inlet opening 172 is adjacent the second feedback outlet 184. Even more preferably, the first and second inlet openings 170 and 172 and the first and second feedback outlets 182 and 184 all are within about a 180 segment of the peripheral wall of the vortex chamber 140.

Now it will be apparent that fluid flowing into the vortex chamber 140 from the first input channel 156 will form a clockwise CW vortex and as the vortex peaks in intensity, some of the fluid will shear off at the periphery of the chamber out of the second feedback outlet 184 into the second feedback channel 180, where it will pass through the curved section 190 and into the second control port 188. This intersecting jet of fluid will cause the fluid exiting the nozzle 152 to shift to the other side of the jet chamber 154 and begin adhering to the opposite side. This causes the fluid to flow up the second input channel 158 entering the vortex chamber 140 in opposite, tangential direction forming a counter-clockwise CCW vortex.

As this vortex builds, some fluid will begin shearing off at the periphery through the first feedback outlet 182 and into the first feedback channel 178. As the fluid passes through the straight section 178*a* and around the curved section 190, it will enter the jet chamber 154 through the first control port 186 into the jet chamber, switching the flow to the opposite wall, that is, from the second input channel 158 back to the first input channel 156. This process repeats as long as an adequate flow rate is maintained.

Figure 5:
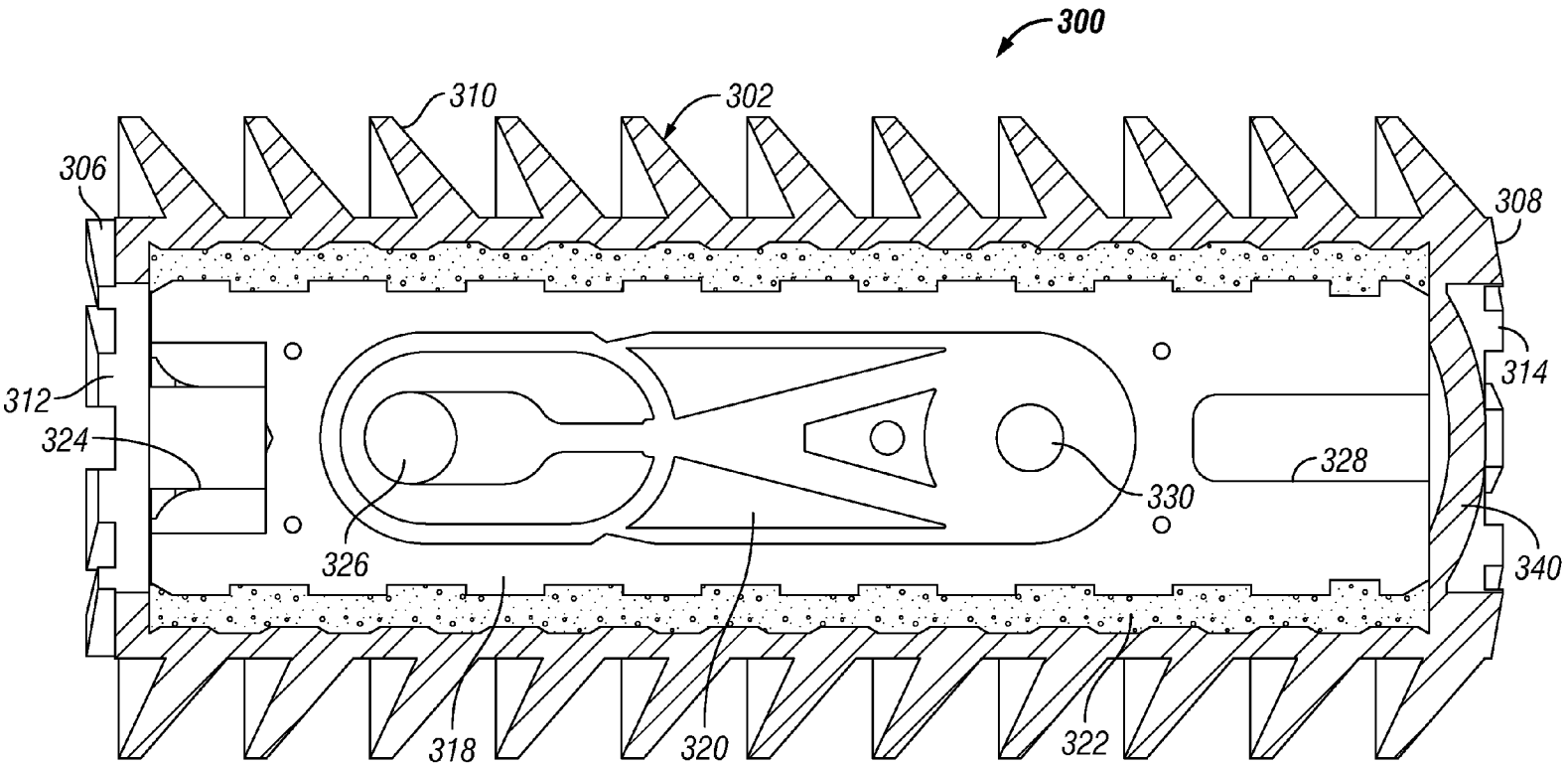
FIG. 5 is a longitudinal sectional view of a casing plug comprising a variable flow resistance device in accordance with a preferred embodiment of the present invention.
Figure 6:
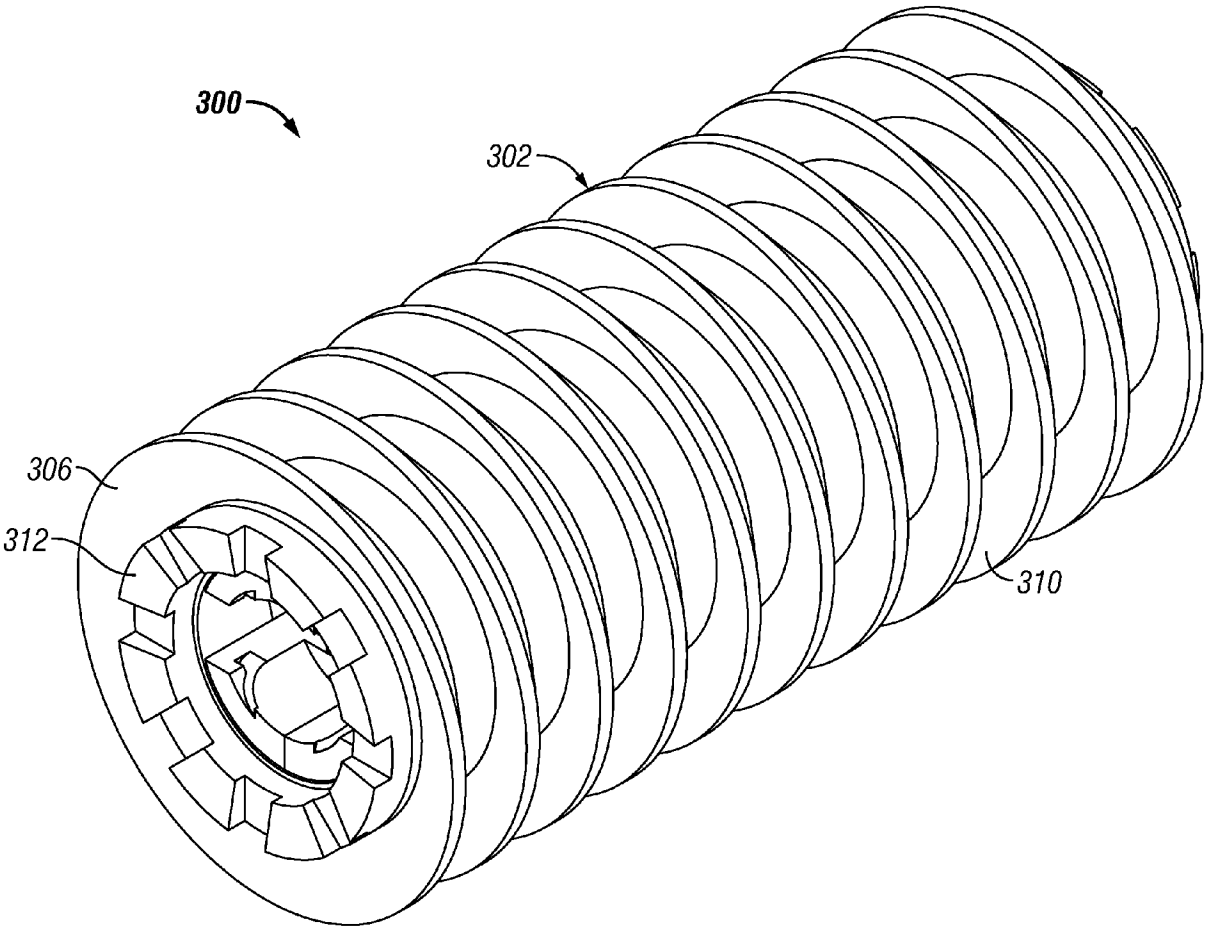
FIG. 6 is a perspective view taken from the uphole or trailing end of the casing plug shown in FIG. 4.
Figure 7:
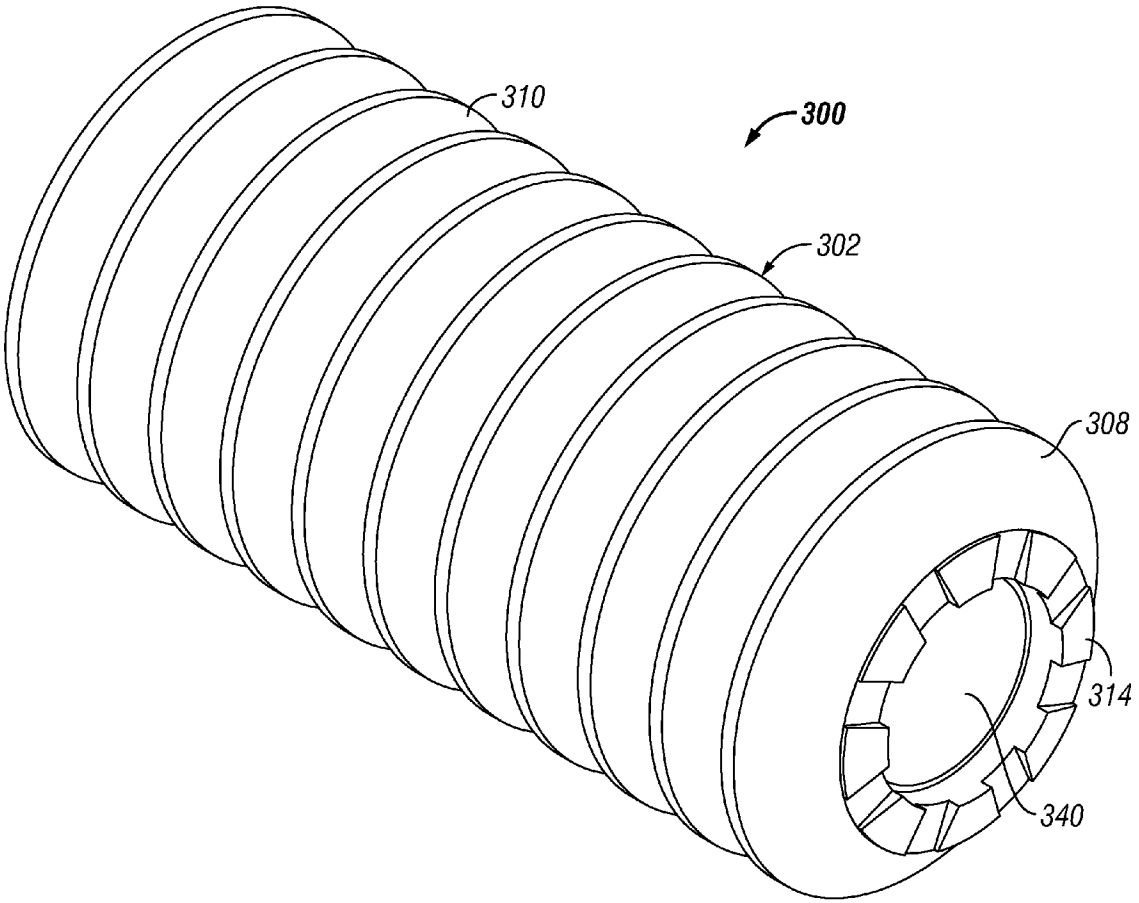
FIG. 7 is a perspective view taken from the downhole or leading end of the casing plug shown in FIG. 4.

With reference now to FIGS. 5-7, another embodiment of the vibrating tool will be described. The vibrating tool 300 shown in these Figures and designated generally by the reference number 300 is a casing plug. As such, it can be pumped down the casing string assembly and "landed" at a target location to become a component of the casing string assembly.

As best seen in FIG. 5, the casing plug 300 comprises a housing 302 with a body section 304 having uphole and downhole ends 306 and 308. The housing preferably is formed with circumferential wipers 310 and is made of rubber. As best seen in FIGS. 6 and 7, the uphole and downhole ends 306 and 308 are provided with teeth 312 and 314. These teeth engage the landing surface to prevent rotation of the plug with a drill bit when the plug is later drilled out of the casing string.

As seen best in FIG. 5, an insert 318 defining a flow path 320 is secured inside the housing body 304 using cement 322. Alternately, the housing 302 may be molded directly on the preformed insert 318.

The insert 318 includes an insert inlet 324 continuous with the uphole end 306 of the plug 300. The insert inlet 324 directs fluid to enter the flow path inlet 326. The insert 318 includes an insert outlet 328 that receives fluid leaving the flow path 320 through the flow path outlet 330. A frangible rupture disc 340 in the downhole end 308, which is ruptured after landing to establish flow through the casing string.

Many variations in the tool are contemplated by the present invention. As indicated above, the configuration of the flow path may be varied. For example, the flow path may have multiple vortex chambers. Additionally, the tool may have multiple flow paths, arranged end to end or circumferentially. These and other variations are described in further detail in our co-pending patent application Ser. No. 13/110,696 entitled "Vortex Controlled Variable Flow Resistance Device and Related Tools and Methods," filed May 18, 2011, and its continuation-in part application Ser. No. 13/427,141, entitled "Vortex Controlled Variable Flow Resistance Device and Related Tools and Methods," filed Mar. 22, 2012.

Having described the various vibrating casing tools of the present invention, the inventive method now will be explained. In accordance with the method of the present invention, a wellbore is finished. As indicated previously, "finished" refers to the process of casing a well bore, cementing a casing string, or both. Where the wellbore is to be cased and then cemented, the wellbore may be finished in a single operation in monobore applications, or in multiple operations in tapered casing applications.

After the wellbore is drilled, or after a first segment of wellbore is drilled, a first casing string assembly is deployed in the well. The first casing string assembly comprises at least one vibrating tool. The vibrating tool may be any of several commercially available vibrating tools that comprise a variable flow resistance device. One such tool is the Achiever brand tool available from Thru Tubing Solutions, Inc. (Oklahoma City, Okla.) Another is the Agitator Brand tool made by National Oilwell Varco (Houston, Tex.). However, in the most preferred practice of the method of the present invention, the vibrating tools used the casing string assembly will be those made in accordance with one or more of the above-described embodiments. In addition to the vibrating tools, the casing string assembly likely will also include float equipment, such as a float shoe or a float collar or both.

This first casing string assembly next is advanced to the target location. This is accomplished by pumping fluid through the first casing string assembly at a rate sufficient to cause the vibrating tool vibrate the casing string assembly while the casing string assembly is being advanced. The type of fluid may vary, so long as the fluid can be pumped at a rate to activate the vibrating tool or tools in the casing string assembly. The fluid may be a circulating fluid (not cement), such as drilling mud, brine, or water. The fluid pumping may be continuous or intermittent. This process is continued until the first casing string reaches the target location.

In some cases, after deploying the casing string, additional vibratory action in the casing string may be desired. In some instances, the vibrating tool may indicate wear. Wear or damage to the vibrating tool of this invention may be indicated by a change in overall circulating pressure, which indicates a change in pressure drop at the tool. This, in turn, suggests that the tool is worn or damaged. Additionally, in some cases, a noticeable decrease in vibration of the casing string at the surface suggests decreasing function of the vibrating tool downhole. Still further, increasing difficulty in advancing the casing may reveal a worn or damaged vibrating tool.

In these cases, where additional vibratory action is desired or the deployed tools are evidencing wear or damage, additional vibrating tools may be added to the casing string assembly by deploying one or more casing plugs, also described above. After one or more vibrating casing plugs of the present invention have been deployed and landed in the casing string, advancement of the casing string assembly is resumed while maintaining fluid flow. This may be repeated as necessary until the target location is reached.

Once the first casing string has been advanced to the target location, the annulus may be cemented. This may be carried out in the conventional manner using top and bottom cementing plugs to create an isolated column of cement. The cement/fluid column created is pumped to force the cement into the annulus. Again, this pumping action continuous to activate the one or more vibrating tools in the first casing string assembly, and this vibrating facilitates the distribution the cement through the annular void. Once the cement is properly distributed, operations are paused and maintained under pressure until the cement sets. At this point, the vibrating tools in the first casing string, as well as any float equipment, can be drilled out of the cemented casing. In the case of tapered casing applications, after the first casing string is drilled out, the wellbore may be extended and second and subsequent casing string assemblies may be installed using the same procedures.

The embodiments shown and described above are exemplary. Many details are often found in the art and, therefore, many such details are neither shown nor described. It is not claimed that all of the details, parts, elements, or steps described and shown were invented herein. Even though numerous characteristics and advantages of the present inventions have been described in the drawings and accompanying text, the description is illustrative only. Changes may be made in the details, especially in matters of shape, size, and arrangement of the parts within the principles of the inventions to the full extent indicated by the broad meaning of the terms. The description and drawings of the specific embodiments herein do not point out what an infringement of this patent would be, but rather provide an example of how to use and make the invention.

What is claimed is:

1. A method for finishing a wellbore comprising:

pumping fluid through a first casing string assembly disposed in the wellbore, wherein the first casing string assembly includes a casing string and at least one vibrating tool, and wherein the fluid is pumped at a rate to operate the at least one vibrating tool to vibrate the first casing string assembly;

wherein the vibrating tool comprises a vortex chamber and a switch to alternate the direction of flow in the vortex chamber between clockwise and counterclockwise.

2. The method of claim 1 wherein the fluid is circulating fluid and wherein the method further comprises:

advancing the casing string while the fluid pumping step is performed until the target location for the first casing string assembly is reached.

3. The method of claim 2 further comprising:

after reaching the target location, cementing the annulus around the first casing string assembly, wherein the cementing step includes pumping cement through the vibrating tool to vibrate the first casing string assembly.

4. The method of claim 3 further comprising:

after cementing the annulus, drilling out the at least one vibratory tool.

5. The method of claim 4 further comprising:

after drilling out the at least one vibratory tool, extending the wellbore.

6. The method of claim 4 further comprising:

after extending the wellbore, deploying a second casing string assembly into the wellbore; and pumping fluid through the second casing string assembly while advancing the second casing string assembly toward a second target location, wherein the second casing string assembly includes a casing string and at least one vibrating tool, and wherein the fluid is pumped at a rate to operate the at least one vibrating tool to vibrate the second casing string assembly.

7. The method of claim 6 further comprising repeating the steps of cementing the annulus and drilling out the vibratory tool.

8. The method of claim 4 further comprising:

after drilling out the at least one vibratory tool, extending the wellbore;

after extending the wellbore, repeating the advancing step, the plug deploying, the cementing step, the tool drilling out step, and the wellbore extension step with a second and subsequent casing string assemblies as needed until the wellbore is completely cased.

9. The method of claim 1 wherein the vibratory tool is a collar installed in the first casing string assembly.

10. The method of claim 1 wherein the vibratory tool is a shoe installed on the end of the first casing string assembly.

11. The method of claim 1 wherein the vibratory tool is a plug landed inside the first casing string assembly.

12. The method of claim 1 wherein the fluid is a circulating fluid.

13. The method of claim 1 wherein the fluid is cement.

14. The method of claim 1 wherein the at least one vibratory tool comprises a plurality of vibratory tools.

15. The method of claim 1 wherein the first casing string assembly further comprises a float shoe or a float collar.

16. The method of claim 1 wherein the fluid is circulating fluid and wherein the method further comprises:

advancing the first casing string assembly while the fluid pumping step is performed;

adding a vibrating tool to the at least one vibrating tool in the first casing sting assembly by deploying a vibrating plug into the first casing string assembly;

repeating the advancing step and the plug deploying steps as needed until the first casing string assembly is advanced to the target location in the wellbore.

17. The method of claim 16 further comprising:

after reaching the target location, cementing the annulus around the first casing string assembly, wherein the cementing step includes pumping cement through the vibrating tool to vibrate the first casing string assembly.

18. The method of claim 17 further comprising:

after cementing the annulus, drilling out the at least one vibratory tool.

19. The method of claim 1 wherein the switch is a fluidic switch.

20. The method of claim 19 wherein the fluidic switch is a Y-shaped bi-stable fluidic switch.

21. The method of claim 1 wherein the switch comprises control ports for alternating flow and wherein the vibrating tool further includes a feedback control circuit that transmits fluid alternately from clockwise and counterclockwise vortices in the vortex chamber to the control ports to alternate flow.

22. A method for finishing a wellbore comprising:

pumping fluid through a first casing string assembly disposed in the wellbore, wherein the first casing string assembly includes a casing string and at least one vibrating tool, and wherein the fluid is pumped at a rate to operate the at least one vibrating tool to vibrate the first casing string assembly;

wherein the vibrating tool comprises a variable flow resistance device that comprises a Y-shaped bi-stable fluidic switch, a vortex chamber, and a feedback control circuit, wherein the switch outputs fluid to the vortex chamber alternately along two diverging paths, both of which are tangential to the vortex chamber to produce alternately clockwise and counterclockwise vortices, and wherein the feedback control circuit transmits fluid alternately from clockwise and counterclockwise vortices to the control ports of the fluidic switch to alternate flow.

23. A method for finishing a wellbore comprising:

pumping fluid through a first casing string assembly disposed in the wellbore, wherein the first casing string assembly includes a casing string and at least one vibrating tool, and wherein the fluid is pumped at a rate to operate the at least one vibrating tool to vibrate the first casing string assembly;

wherein the vibrating tool comprises a variable flow resistance device that comprises:

an inlet and an outlet;

a jet chamber having first and second control ports;

a nozzle to direct fluid from the inlet into the jet chamber;

first and second input channels diverging from the jet chamber;

a vortex chamber continuous with the outlet and having first and second inlet openings and first and second feedback outlets, wherein the first and second inlet openings of the vortex chamber are positioned to direct fluid in opposite, tangential paths into the vortex chamber so that fluid entering the first input inlet opening produces a clockwise vortex and fluid entering the second inlet opening produces a counterclockwise vortex, and wherein the first and second feedback outlets of the vortex chamber are positioned to direct fluid in opposite, tangential paths out of the vortex chamber, whereby fluid in a clockwise vortex will tend to exit through the second feedback outlet and fluid in a counterclockwise vortex will tend to exit through the first feedback outlet;

wherein the first and second inlet openings of the vortex chamber are continuous with the first and second input channels and wherein each of the first and second input channels defines a straight flow path from the jet chamber to the first and second inlet openings, respectively, of the vortex chamber;

a first feedback channel extending from the first feedback outlet of the vortex chamber to the first control port in the jet chamber; and a second feedback channel extending from the second feedback outlet of the vortex chamber to the second control port in the jet chamber;

whereby fluid from a counter-clockwise vortex passing through the first feedback channel to the first control port will tend to switch fluid flow from the second input channel to the first input channel, and fluid from a clockwise vortex passing through the second feedback channel to the second control port will tend to switch fluid flow from the first input channel to the second input channel.

* * * * *